United States Patent [19]

Stüvecke

[11] 4,361,180

[45] Nov. 30, 1982

[54] STRETCHER FRAME FR DECORATIVE MATERIALS

[76] Inventor: Claus P. Stüvecke, Stresemannallee 90, 2000 Hamburg 54, Fed. Rep. of Germany

[21] Appl. No.: 104,303

[22] Filed: Dec. 17, 1979

Related U.S. Application Data

[63] Continuation-in-part of Ser. No. 887,420, Mar. 16, 1978, abandoned.

[30] Foreign Application Priority Data

Mar. 17, 1977 [DE] Fed. Rep. of Germany ..... 2711618

[51] Int. Cl.³ ..... E06B 3/30

[52] U.S. Cl. ..... 160/377; 160/371

[58] Field of Search ..... 160/377, 378, 374.1, 160/371, 354; 135/4 R, 15 PQ; 403/53, 62, 102; 38/102, 102.4, 102.9; 16/157, 191

[56] References Cited

U.S. PATENT DOCUMENTS

| | | | |
|---|---|---|---|
| 311,827 | 2/1885 | Graver | 160/377 |
| 753,710 | 3/1904 | Keil | 16/157 X |
| 1,073,341 | 9/1913 | Gleaves | 160/377 X |
| 1,504,889 | 8/1924 | Hansen | 135/4 R |
| 1,827,729 | 10/1931 | Brooks | 135/4 R |
| 1,847,925 | 3/1932 | Carter | 160/374.1 |
| 2,042,874 | 6/1936 | Acker | 38/102.9 X |
| 2,594,464 | 4/1952 | Loucks, Jr. | 403/102 X |
| 3,494,409 | 2/1970 | Prechtl et al. | 160/377 X |
| 3,651,854 | 3/1972 | Terna | 160/374.1 |
| 3,886,990 | 6/1975 | Campione | 160/374.1 |

FOREIGN PATENT DOCUMENTS

| | | |
|---|---|---|
| 1406643 | 6/1965 | France . |
| 944994 | 12/1963 | United Kingdom . |

*Primary Examiner*—Philip C. Kannan

*Attorney, Agent, or Firm*—Remy J. VanOphem

[57] ABSTRACT

A stretcher frame for decorative materials used as wall hangings, for artists' canvasses and the like which includes four limbs defining a rectangle, two of which can be folded inwardly at their centers so that the frame can be folded up concertina-fashion. Hinge connections are provided at each corner of the frame and at the midpoints of the folding limbs. The four limbs remain permanently connected by the hinge connections and the folded frame can be easily transported and stored. If the covering material can be folded it can remain in place on the frame when the frame is folded. The hinge connections include flat link members which are normally concealed within slots in the limbs.

10 Claims, 13 Drawing Figures

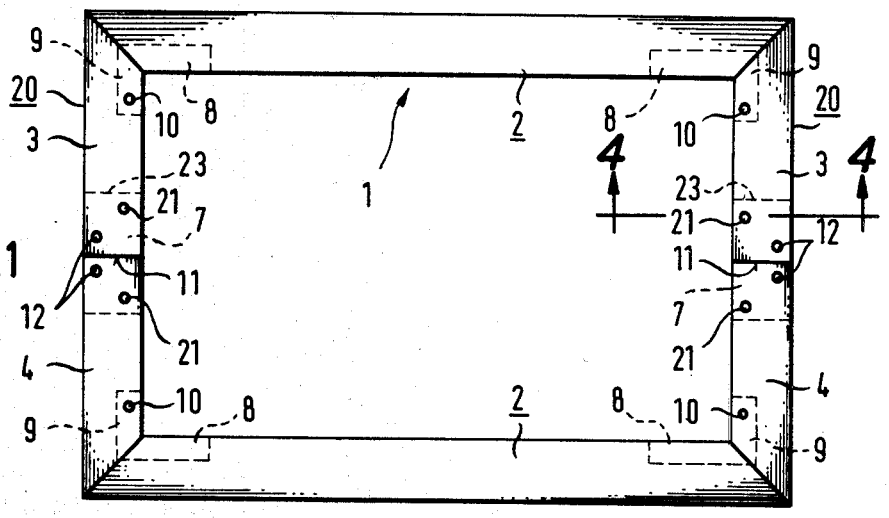
FIG.1
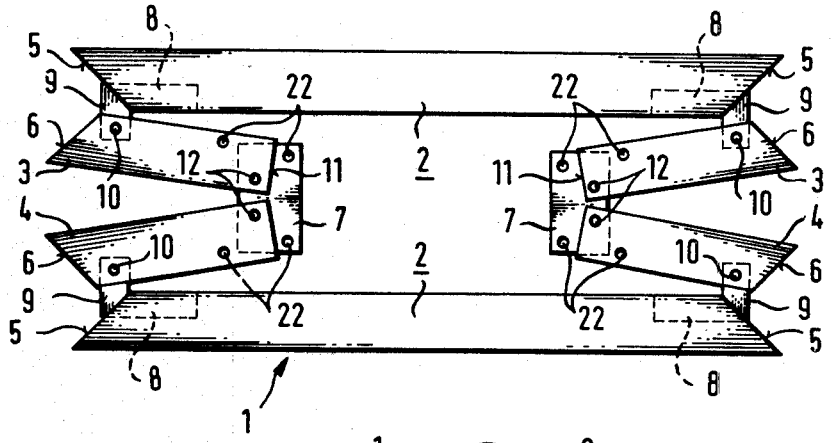
FIG. 2
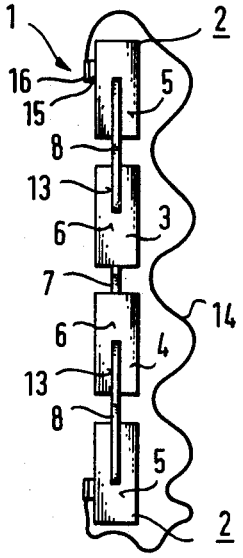
FIG.3
FIG.4
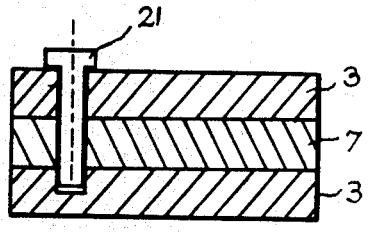

STRETCHER FRAME FR DECORATIVE MATERIALS

This application is a continuation-in-part of pending application Ser. No. 887,420, filed Mar. 16, 1978, now abandoned.

FIELD OF THE INVENTION

This invention relates to a stretcher frame for decorative materials serving as wall hangings, for artists' canvasses and the like. The frame comprises four connected limbs forming a rectangle, for example a square, each end face of each limb being inclined back towards the inner edge of the limb, and with the end faces of adjacent limbs in contact one with another.

DESCRIPTION OF THE PRIOR ART

Rigid frame structures of this type are known in which for example a canvas is stretched over the frame and is secured to the back of the frame limbs by suitable fastening means, for example by means of tacks. If the frame is to be used as a stretcher frame for decorative material serving as a wall hanging, then a suitable piece of the ready-made decorative material has to be drawn back over the front edge of the frame and, as mentioned above, be secured to the back of the limbs of the frame. It will also be clear that the transportation of rigid frames of this type, whether they are already fitted with a canvas or decorative material or not, can only be carried out with difficulty, particularly in the case of frames of large dimensions. This disadvantage becomes a particular problem if the frame is to be used as a replacement frame for decorative material serving as a wall hanging. In this case an accurate cutting of the decorative material to the frame dimensions is necessary, as the decorative material is already a manufactured product and in most cases has already been stretched onto the frame in the factory in order to relieve the purchaser of the troublesome task of mounting the decorative material on to the frame. The frame fitted with the decorative material then has to be transported home, which is correspondingly, troublesome and difficult. If then another decorative material is to be fitted and if one does not wish to or cannot carry this out oneself then a similarly involved transportation process is again necessary.

A further disadvantage of the known rigid frames is that these frames, even when they are not being used, take up the same space as when they are being used. The frame structure is bulky which creates problems with packing and safe storage techniques.

SUMMARY OF THE INVENTION

It is an object of the present invention to provide a stretcher frame for decorative materials serving as wall hangings, for artists' canvasses and the like which is easy to transport even when the frame is already fitted with a ready-made piece of decorative material, and further to provide a frame which when it is not in use takes up only a relatively small space.

This is achieved in accordance with the present invention by a frame including four limbs which are connected to one another and form a rectangle, each end face of each of the limbs being inclined back towards the inner edge of the respective limb and the angled end faces of adjacent limbs abutting one another; first connector means at each of the four corners of the frame; and second connector means half-way along the length of each limb of an opposed pair of limbs, each limb provided with a second connector means thereby forming a pair of hinged limb portions which are rotatable in the plane of the frame inwardly to a position substantially parallel to the adjacent non-folding limbs, whereby the frame is foldable concertina-fashion.

Thus, in order to solve the problems referred to above, the frame is formed as a foldable frame in which the two shorter limbs of the frame, or in the case of four limbs of equal length one of the pairs of opposed limbs, are constructed as folding limbs. This can be achieved in practice by providing a jointed connection at each of the four corners of the frame and by providing each of the folding limbs half-way along its length with a further jointed connection which thus divides each of these folding limbs into two inwardly foldable limb portions. If the frame is in its opened-out state, then simply by exerting a lateral inward pressure on the two jointed connections at the centers of the foldable limbs the respective limb portions fold inwards so that the frame can then be collapsed concertina-fashion merely by exerting pressure on the other two limbs which are not jointed. When the frame is in this collapsed state, the limb portions which have been folded inwards then lie substantially parallel to one another and also parallel to the non-folding limbs of the frame, so that the frame then only has a height which is approximately equal to the width of four limbs. Consequently, it is much easier to transport this frame than a rigid frame structure of the known type. The folded frame can also be packed much better and more easily; the frame, if it is no longer being used, can also be stored more easily without taking up a great deal of space.

The frame in accordance with the present invention is particularly advantageous for use with decorative materials used as wall hangings. It is customary to produce from such materials a piece of material adapted to the frame size, this piece of material then being stretched on to the frame either in the factory or by the purchaser himself at home. In most cases the measuring of the frame and the unrolling of the material onto the frame, the stretching of it over the frame and the fastening of the material to the frame is regarded as an inconvenience by the purchaser, so that this task is carried out as far as possible in the factory from which the frame and the appropriate decorative material can be purchased. Naturally, an already fitted frame of this type necessitates that it be very carefully packed and transported, and there is a danger that the decorative material which is under tension may suffer damage during transportation. On the other hand, with a frame formed in accordance with the present invention these disadvantages are avoided. Thus, with the frame in its opened-out state, a piece of a decorative material can be prepared to the size appropriate for the frame, and then this piece of material can be fastened to the back of the non-folding frame limbs. The frame can then be collapsed and transported in this folded state. When the frame reaches its destination all that the purchaser needs to do is to open out the folded limbs and fasten the piece of material to the back of these folding limbs of the frame. One thus achieves, without any difficulty whatsoever, a wall hanging which is indistinguishable from one mounted on a rigid frame construction which has a decorative material stretched over it. If one wishes to change the decorative material, then it is only necessary to release the material stretched on the frame from the back of the folding limbs, to collapse the frame, and then take or send it back to the factory, shop, etc. where the frame can be fitted with a new piece of material.

According to a preferred embodiment of the invention each second connector means is such that the limb portions which it connects abut one another at their end faces with the limb portions in their opened-out state, each of the second connector means includes a flat link member no wider than the limbs which is connected to the two adjacent folding limb portions at outer edge regions of the limb portions, and each link member is received within slots parallel to the plane of the frame in the end regions of the folding limb portions adjacent to the link member.

This structural formation of the jointed connections ensures that each pair of limb portions can only be folded inwardly into the area of the frame and not outwardly. When the limb portions are located in the opened-out position, then their end faces abut each other so that any further outward rotation is impossible. In addition to this, the dimensions of the slots are preferably such that in the opened-out position of the folding limb portions an internal surface of each slot forms an abutment stop for the associated link member so that any excessive outward rotation of the folding limb portions is also prevented by this means. Each link member preferably has a maximum width equal to the width of the limb, so that in the opened-out state of the limb portions it does not project laterally beyond the limbs and consequently cannot cause any damage.

In the opened-out position the link members are received completely by the slots provided in the limb portions, so that each link member is fully enclosed and fastening of the decorative material or of the canvas is in no way hindered. It is essential due to the arrangement of the link members and by the articulated connection of the limb portions to the link members at their outer regions that both limb members can be rotated inwardly without any danger of one limb portion jamming against the other.

Although each pair of limb portions in their opened-out positions already fit together with a moderately firm seating, according to a preferred embodiment of the invention these limb portions can be locked in their opened-out position by means of pins which are inserted into holes formed through the limb portions and through the link members. By means of these pins which are fitted into the holes one achieves a locking effect which then makes it impossible to fold the limb portions inwardly. Thus, before the frame can be folded up, one must first remove the locking pins from their holes. As an alternative to this, other ways of achieving the same locking effect may be used, for example by the use of locks, ring bolts and the like.

Preferably, the jointed connections at the corners of the frame are formed by first connector means each including a flat connecting piece no wider than the limbs having a portion projecting from the end face of one of the non-folding limbs perpendicular to the longitudinal axis of the non-folding limb, the adjacent folding limb portion being rotatably connected to the free end of projecting portion of the connecting and the projecting portion being received in an internal slot in the folding limb portion extending parallel to the plane of the frame.

By this constructional formation of the jointed connection at each corner of the frame one insures that the respective folding limb portions can be folded relative to the adjacent non-folding limbs freely inwardly into the interior of the frame without there being any danger of the folding movement being obstructed. In this way one also insures that in the opened-out position of the limb portions their angled end faces, preferably angled inwardly at an angle of 45° to the longitudinal axis of the folding limbs, have their angled end faces firmly abutting against the adjacent non-folding limbs. The point of rotation of the jointed connection preferably lies sufficiently far outside the cross-section of the non-folding limbs that the folding limb portions can be rotated inwardly to a position in which they occupy a position parallel to the non-folding limbs.

The internal slots provided in the folding limb portions fully conceal the connecting pieces when the folding limbs are fully opened out, so that the connecting pieces do not cause any damage or annoyance.

The folding limb portions are preferably rotatably connected both to the link members and to the connecting pieces by means of hinge pins. According to the nature of the material used for the frame, preferably wood, these hinge pins can include screw bolts, wooden dowel pins, plugs and like connectors.

The advantages which can be achieved with the frame in accordance with the present invention are particularly strongly evident in a preferred embodiment of frame in which means for releasably fastening a piece of decorative material are provided at the back of the frame limbs. A gripping strip has been found to be particularly good for this purpose, the strip being provided on the back of the limbs around the full circumference of the frame. This arrangement has the advantage that the piece of material, the edges of which may be provided with a corresponding fastening means, can be secured rapidly and simply to the frame. For this purpose one can use for example an adhesive tape, particularly self-adhesive strips.

Further advantages arise from a further preferred feature of the invention in which the frame is provided with a ready-made piece of decorative material which is fastened to the back of the two non-folding limbs and which can be fixed to the back of the folding limbs after they have been opened out to their extended positions. Consequently, the frame can be prepared fully finished with the piece of material mounted thereon, the piece of material being fastened initially only to the back of the two non-folding limbs and being fixable to the folding limbs only after they are opened out. Upon opening out of the folding limbs the piece of material is tensioned in the direction perpendicular to the longitudinal axes of the non-folding limbs, and this tensioning effect can be regulated by appropriate dimensioning of the piece of material in the direction perpendicular to the longitudinal axes of the non-folding limbs.

There is in this the further advantage as compared with the conventional rigid framework that the decorative material is in this way tensioned by the frame itself as compared with the conventional frame where the material has to be pulled manually over the frame to create the necessary tension and then has to be fastened to the back of the frame.

When the frame has been fully opened out it is then only necessary for one to secure the side edges of the piece of material to the respective frame limbs, and this can be accomplished simply and quickly by means of a gripping strip provided for this purpose. Naturally, the piece of material must be so shaped at the corners that it matches the shape of the corners of the frame. Preferably, the piece of material is suitably cut at its corners to correspond to the inclined ends of the individual limbs of the frame.

The manufacture of the wall hanging is now complete and it can be handled and transported in a convenient way simply by releasing the edges of the piece of material from the folding limbs and then collapsing the frame. At its destination the collapsed frame can easily be erected by pushing out the folded limbs into their opened-out positions and by securing the locking pins if provided. This automatically causes the above-mentioned tensioning effect to be imparted to the material. Thereafter, one has only to fasten the edges of the piece of material to the back of the folding limbs so that the finished wall hanging is again ready for display. A tensioning effect across the material or canvas can also be achieved by appropriate positioning of the gripping strip on the folding limbs and by appropriate dimensioning of the piece of material in this direction. Replacement of the decorative material, whether undertaken at the place of use or in the factory, can be accomplished in a correspondingly simple way. It is of particular significance that with the use of an adhesive strip the tensioning of the material can be accomplished manually so that even unskilled persons can achieve a tight fitting of the material.

Having regard to conventional frames it should also be pointed out that stretcher frames of a type which require a push-fit assembly are known. As compared with frames of this known type the frame in accordance with the present invention has the advantages that it takes no time at all to assemble the frame and to tension the decorative material, and that even an unskilled person can perform the simple steps involved without any difficulty. The frame can be speedily opened out in the factory for example, the material tensioned and then be forwarded to the customer. In order to prepare frames and decorative material for transportation there is likewise no need for time-consuming dismantling of the frames and covering materials or canvasses. Frames can be simply collapsed and the decorative material folded around the frame, which because of the soft nature of the material, gives rise to no difficulties. The frame of the present invention also has advantages over the known push-fit frame assemblies in respect of storage since, with the frame of the present invention, one does not have the problem of storing a number of individual pieces.

As a decorative material to be mounted on the frame one can use textile materials for example, including synthetic materials, woollen materials, etc.

BRIEF DESCRIPTION OF THE DRAWINGS

In order that the invention may be fully understood a preferred embodiment of the frame in accordance with the invention will now be described by way of example and with reference to the accompanying drawings, in which:

FIG. 1 is a rear view looking at the back of a stretcher frame in accordance with the present invention with the frame in the opened-out state;

FIG. 2 is again a rear view of the frame shown in FIG. 1, with the frame shown in a partially collapsed or folded state;

FIG. 3 is a side view of a frame shown in FIGS. 1 and 2, the frame being shown in its fully collapsed or folded state and fitted with a ready-made piece of decorative material to serve as a wall hanging;

FIG. 4 is a cross-section taken substantially through lines 4—4 in FIG. 1 and showing the locking pin 21;

DESCRIPTION OF THE PREFERRED EMBODIMENTS

Figure 8:
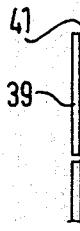
FIG. 8 is a diagrammatic partial side view in the direction indicated by the arrow VIII in FIG. 5.

Considering the Figures of the drawings in turn, it will be seen that FIG. 1 shows a stretcher frame 1 which is adapted to be used as a mounting for decorative material serving as a wall hanging, for an artist's canvas or the like. The frame 1 consists of four frame limbs 2, 20 which are connected to one another and which together form a rectangle. The end faces 5, 6 of the respective limbs are inclined at an angle of 45° to the longitudinal axis of the respective limbs, being tapered back towards the inner edge of each limb. These end faces 5, 6 abut the end faces of the adjacent limbs.

FIG. 1 shows a frame with two opposed short limbs 20 and two opposed longer limbs 2. It will be apparent that the frame could equally well be square and that it would then consist of four limbs of equal length.

As can be seen from FIGS. 1 and 2, jointed connections are provided at the four corners of the frame. Moreover, the two opposed shorter limbs 20 are each provided with a jointed connection halfway along their length and by means of which the respective pairs of limb portions 3, 4 formed thereby can be rotated in the plane of the frame inwardly to a position parallel to the adjacent limbs 2, the frame thus being foldable concertina-fashion. The jointed connections between the folding limb portions 3, 4 are each formed so that the two adjacent ends of the limb portions are hinged to a common link member 7. Each link member 7, the width of which in the embodiment shown in FIGS. 1 and 2 corresponds exactly to the width of the limbs, is housed within internal slots extending parallel to the plane of the frame in the end regions of the folding limb portions 3, 4 adjacent to the link member. These internal slots each have an end wall 23 which, in the opened-out state of the frame, forms an abutment stop for the link member 7. The folding limb portions 3, 4 are rotatably connected to the link member 7 by means of suitable connecting pins or bolts 12. These connecting pins 12 are positioned close to the outer edge of the respective limb portions so that the two limb portions can be folded inwards without any interference one with the other. The adjacent end faces 11 of the folding limb portions 3, 4 lie at right-angles to the longitudinal axis of these limbs so that in the fully opened state the end faces 11 of the limb portions are thrust against one another and consequently prevent any further outward rotation of the limb portions. In this fully opened state the pairs of limb portions 3, 4 can be locked to the link members 7 by fitting locking pins 21 into holes 22 provided for this purpose through the limb portions and through the link members. These locking pins 21 make it impossible for either of the folding limb portions of either pair to move inwards, so that the frame is ready for use in this state.

The jointed connections at the corners of the frame each include a flat L-shaped connecting piece 8 having one arm 9 extending from the end face 5 of the non-folding limb 2 in a direction perpendicular to the longitudinal axis of the limb 2. The width of the connecting pieces 8 is smaller than the width of the limbs. Each projecting arm 9 has a respective end of one of the folding limb portions 3, 4 rotatably connected to it by means of a connecting pin 10. The free arms 9 of the connecting pieces 8 extend into internal slots 13 in the folding limb portions 3, 4 these slots 13 extending parallel to the plane of the frame. Because of the fact that in this way the point of rotation of each of the folding limb portions lies outside the cross-section of the non-folding limbs 2, the folding limb portions can be rotated freely relative to the non-folding limbs inwardly to a position where they lie parallel to the non-folding limbs. On the other hand, the inclined end faces 6 of the folding limb portions themselves firmly abut against the inclined end faces 5 of the non-folding limbs in the opened-out position of the frame, so that with the frame in the opened-out state one has the impression of a conventional rigid frame. It is also a fact that after the locking of the folding limb portions 3,4 to the link members 7 one has a rigid connection between the shorter limbs 20 and the longer limbs 2 of the frame.

FIG. 2 shows the frame in a position in which the folding limbs 20 occupy a position in which their limb portions 3, 4 lie approximately parallel to the longitudinal axes of the non-folding limbs 2. Naturally, in such a position the locking pins 21 are removed from the respective holes 22 which extend through the limb portions 3, 4 and through the link members 7. In this position a part of each link member 7 projects from the slots provided in the folding limb portions, but this is quite harmless because there is a sufficiently large free space within the interior of the frame.

In order to collapse the frame for transportation one first removes the locking pins 21 from the holes 22, and then by exerting an inwardly directed force on the outside of the folding limb portions 3, 4 at their central regions the folding limb portions are caused to rotate inwardly at each side of the frame to a sufficient degree for the exertion of inward pressure on the non-folding limbs 2 to cause the folding limb portions 3, 4 to be brought to their final positions in which they lie substantially parallel to the adjacent non-folding limbs 2. The frame is then in a convenient form to be packed and transported. At the destination or place of use the two non-folding frame limbs 2 are pulled apart, and by exerting outward pressure on the link members 7 the two folding limbs are straightened into their opened-out positions. Replacement of the locking pins 21 then makes the frame again ready for use.

FIG. 3 is a side view of a special form of the frame shown in FIGS. 1 and 2, in which the frame is provided with a ready-made piece 14 of decorative material. The lower and upper non-folding frame limbs 2 can be seen in FIG. 3 as well as the folding limb portions 3, 4 which here occupy a position parallel to the non-folding limbs 2. The end faces 5 of the non-folding limbs as well as the associated end faces 6 of the folding limb portions 3, 4 are inclined to the plane of the drawing. The connecting pieces 8 which are connected fixedly with the non-folding limbs 2 are also visible in FIG. 3, and the free arms 9 of these connecting pieces extend into the internal slots 13 of the folding limb portions 3 and 4. Also visible is a part of one of the flat link membes 7 by which the folding limb portions 3, 4 are connected to one another.

The ready-made piece 14 of decorative material is fastened to the back of the non-folding limbs 2 by means of a gripping strip 15 on these limbs and a felt strip 16 positioned along the edges of the piece of material and which is arranged to bond with or adhere to the gripping strip 15. If the frame is now opened out, then the piece of material is tensioned, by the opening out of the folding limb portions 3 and 4, in a direction perpendicular to the longitudinal axes of the non-folding limbs 2. After the folding limb portions have been locked into place the piece of material 14 then only needs to be fastened to the back of the two shorter limbs 20 which can be provided in the same way with the gripping strips 15 for engagement with the felt strips 16. The frame with the piece of material mounted thereon can then be suspended as a wall hanging.

If the wall hanging is to be transported or packed then the piece of decorative material is first released from the back of the shorter limbs 20 of the frame, and then after the locking pins have been removed these shorter limbs are folded inwards. The frame can then be collapsed concertina-fashion and in this state can be packed or transported. It is of course also possible to release the piece of material completely from the frame by unfastening the whole gripping strip and thus to pack and/or transport the frame without the decorative material. As is shown in FIG. 3, after the collapsing of the frame the decorative material can be folded around the frame, this being possible because of the softness of the material. In this state the frame already provided with the decorative material can be safely transported or stored.

FIGS. 5 to 9 illustrate another embodiment of a stretcher frame the basic function of which is similar to that of the frame illustrated in FIGS. 1 to 3; for that reason, only part of the structure is illustrated.

Figure 5:
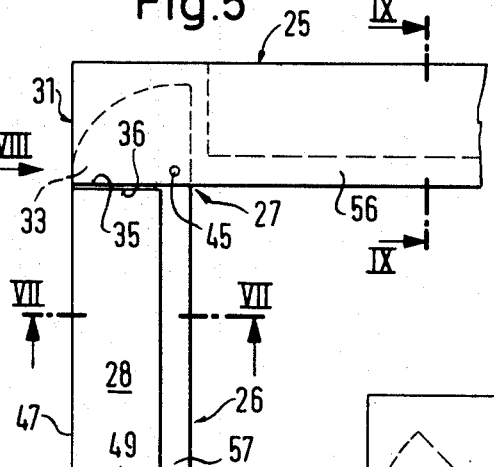
FIG. 5 is a diagrammatic partial front or rear view of another embodiment of a stretcher frame in the extended condition.

The stretcher frame illustrated in FIGS. 5 to 9 is also particularly suited for decorative materials serving as wall hangings, for artists' canvasses, and the like. The frame includes two pairs of opposed limbs, the limbs 25 of the first pair being non-foldable and at least as long as the limbs 26 of the second pair, which are foldable. In FIG. 5, only one limb of each pair is shown. The first or non-foldable limbs 25 are somewhat longer than the second or foldable limbs 26 to permit complete collapsing of the frame in the manner illustrated in FIG. 6 similar to the embodiment shown in FIGS. 1 to 3. The limbs are hinged to one another in their end regions by first connector means 27 at each of the four corners of the frame for relative rotatable movement in the plane of the frame between an extended condition in which the limbs 25, 26 form a rectangle, and a collapsed condition in which the limbs are disposed close together in a substantially parallel relationship. Each of the limbs 26 of the second pair is subdivided half-way along its length, and the limb portions 28, 29 so formed are hinged together by second connector means 30 to be foldable inwards in the plane of the frame, whereby the frame is collapsible concertina-fashion in the manner illustrated in FIG. 6, or in FIGS. 1 and 2. The first and second connector means 27, 30 each include a slot 31 and 32, respectively, formed in one of the interconnected limbs or limb portions, and a flat hinge link 33 and 34, respectively, which is connected to and in the embodiment illustrated forms an integral part of the associated other limb 26 or limb portion 29, respectively, and is pivotally supported in the associated slot 31 and 32, respectively. As shown in FIG. 5, the hinge links 33, 34 are shaped to be completely received in their associated slots in the extended condition of the frame. The limbs and limb portions have end faces 35, 36, and 37, 38, respectively, which abut and are thrust against each other in the extended condition of the frame to prevent overextension of the frame and to properly define the desired rectangular shape of the extended frame.

Figure 9:
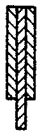
FIG. 9 is a diagrammatic sectional view along line IX—IX of FIG. 5.
Figure 7:
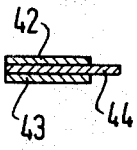
FIG. 7 is a diagrammatic sectional view along line 7—7 of FIG. 5.

As shown in FIGS. 7 to 9, the limbs and limb portions are constituted each by a plurality of superimposed interconnected sections of sheet material. For example, the non-folding limb 25 consists of three superimposed sections, two outer sections 39 and 40, and an intermediate section 41. Each of the halves of the second folding limb 26 also consists of three superimposed sections, two outer sections 42 and 43, and an intermediate section 44. The marginal contours of the sections are selected so that the hinge links 33 and 34, and the associated slots 31 and 32 are formed.

Figure 6:
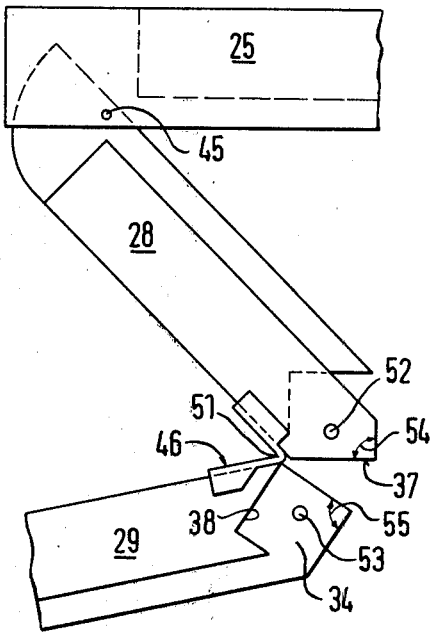
FIG. 6 is again a diagrammatic partial front or rear view of the frame shown in FIG. 4 with the frame shown in a partially collapsed or folded state.

As can be easily seen in FIGS. 5 to 9, the frame illustrated therein is very easy to manufacture, particularly by automatic machinery, because the individual sections or cuts of sheet material can be very easily stamped or cut out from a continuous sheet material, and the various sections can then be easily, automatically selected, stacked and interconnected properly to form the limbs 25 and the limb portions 28 and 29. The interconnection of the individual sections or cuts can be effected by well-known methods, depending upon the kind of sheet material. It has been found that it is particularly advantageous to use a sheet material of low specific weight, such as cardboard, plastic, light weight honeycomb panels, corrugated paper, and the like. In most cases, the individual sections or cuts can be interconnected simply by cementing, using a suitable adhesive, and with many materials, particularly plastic sheet material, it is also possible to weld the superimposed sections together. To improve the strength of the limbs, it is generally recommendable to interconnect the superimposed sections across substantially the whole contacting surface areas. When using a curable material such as an adhesive, on porous sheet material such as cardboard or corrugated paper, it is in many cases possible to have the adhesive penetrate into the sheet material, whereby after curing of the adhesive, a very strong but light structure is obtained. Reducing the weight of the frame is an advantage which directly adds to the other main advantage of the frame, namely the possibility of reducing the volume by collapsing the frame; both features are advantageous for storing, stacking, and shipping of the frames. Since the collapsing feature of the frames described is primarily useful for storing and shipping the frames, the conversion from the collapsed into the extended condition, and vice versa, will normally be effected by the customer very few times. Accordingly, it will be generally sufficient to use very simple connector means and to thus reduce the manufacturing costs even further. In the embodiment illustrated in FIGS. 5 to 9, the first connector means 27 each include a simply nailed-through pin 45 which embodies the axis of rotation of the connector means 27 and holds the associated limb 25 and limb portion 28 together. Also the second connector means 30 is of a very simple construction in the embodiment illustrated in FIGS. 5 to 9. In addition to the already described slot 32 and the flat hinge link 34 adapted to engage into the slot, the second connector means 30 each include a hinge 46 of a thin, flexible material, which strip is fastened to and bridges the adjacent terminal portions of the outer edges 47, 48 of the two limb portions 28, 29 to be connected. If the total width of the edges 47 and 48, measured transverse of the plane of FIG. 8, is rather small, for instance when using, as illustrated in FIGS. 7 to 9, only three superimposed layers of relatively thin sheet material, the strength of the connection between the hinge strip 46 and the associated limb portions 28 and 29 can be improved by using a hinge strip, as illustrated, which has a first lateral extension 49 fastened to the one limb portion 28, for instance by means of an adhesive, and a second lateral extension 50 fastened to the other limb portion 29. The extensions 49 and 50 preferably extend in a straddling manner on both the front and rear surfaces of the limb portions 28, 29. It has been found that it is generally sufficient to use a very thin material for the hinge strip, preferably a usual type of adhesive tape. Hinge strips 46 of that kind can be attached to the limb portions simply by pressing-on, and they are so thin that they do not appreciably increase the cross-section of the limb portion. As shown in FIGS. 5 and 6, a central portion of the hinge strip 46 is without extensions, and this central area 51, where the ends of the outer edges 47 and 48 of the limb portions 28 and 29 meet, acts as a transverse pivot axis for the relative pivotal inwards movement of the limb portions 28 and 29 during collapsing of the frame, as illustrated in FIG. 6. This pivot axis desirably is disposed at the outer edge of the folding limb 26. By that feature, and due to the abutment of the end faces 35, 36, and 37, 38, the frame normally will not by itself collapse from the extended condition. However, in order to increase the stability in the extended condition, locking means can be provided to lock the frame in the extended condition. In the embodiment illustrated in FIGS. 5 to 9, pin holes 52 and 53 are provided in areas of the limb portions 28 and 29 which overlap in the extended condition. A locking pin with a thin head 53A can be pushed through the aligned pin holes. As a further means for increasing the strength of the frame in the extended condition, the mutually abutting end faces 37, 38 of the limb portions 28, 29 have interlocking profiles. In the embodiment illustrated, such interlocking profiles simply are provided by extending the end faces 37, 38 to include a right angle 54, 55. Of course, other kinds of interlocking profiles can be used which do not interfer with the relative movement of the limb portions 28, 29. Similarly, interlocking profiles can be provided in the abutting end faces 35, 36.

In order to increase the strength of the frame in the collapsed condition, the first and second limbs 25, 26 comprise marginal portions 56 and 57, respectively, which are portions of the sections of sheet material and interengage in the collapsed condition. In the embodiment illustrated in FIGS. 5 to 9, the interengaging marginal portions 56, 57 are simply extensions of the slot 31 and the flat hinge link 34, respectively. In this manner, increased strength can be insured in the collapsed condition, which is advantageous for shipping purposes.

The strength of the frame can be further increased by using a larger number of superimposed sections or cuts of sheet material. In the connector means, greater strength can be obtained accordingly in that a plurality of superimposed slots and hinge links are formed by a corresponding number of superimposed sections.

Figure 11:
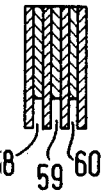
FIG. 11 is a diagrammatic sectional view corresponding to FIG. 9 but of the embodiment illustrated in FIG. 10.
Figure 10:
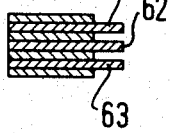
FIG. 10 is a diagrammatic sectional view corresponding to FIG. 7 but of a still further embodiment.

FIGS. 10 and 11 illustrate a further embodiment having that feature; in other respects, the embodiment is identical with that shown in FIGS. 5 to 9, so FIGS. 5 to 9 may also serve to illustrate the embodiment of FIGS. 10 and 11. As can be easily seen from FIGS. 10 and 11, a total of seven superimposed sections are used for the limbs 25 and 26, providing a plurality of three superimposed slots 58, 59, 60, and three hinge links or marginal portions 61, 62, 63 adapted to enter the slots.

Figure 13:
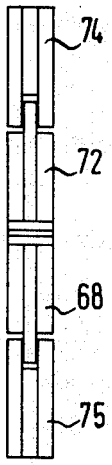
FIG. 13 is a diagrammatic side view in the direction of the arrow XIII in FIG. 12.
Figure 12:
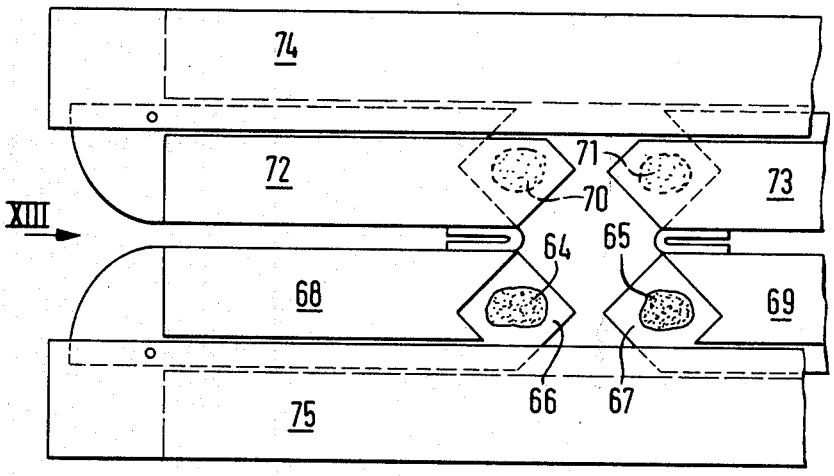
FIG. 12 is a diagrammatic partial front or rear view of a still further embodiment in the collapsed condition.

FIGS. 12 and 13 illustrate a further embodiment which is destined to be extended only once from the collapsed condition (as illustrated) into the extended condition. Accordingly, this embodiment is particularly suited for a stretcher frame package which comprises the frame in the illustrated collapsed condition. Generally, the embodiment of FIGS. 12 and 13 is identical with that illustrated in FIGS. 5 to 9; however, means for locking the frame in the extended condition are provided in the form of an adhesive which is provided on areas of the slots and hinge links which are separated in the collapsed condition of the frame but overlap in the extended condition, whereby the adhesive becomes effective upon the extension of the frame. As illustrated in FIG. 12, a particularly advantageous embodiment of that kind employs a two component adhesive material in which each component alone is non-solid but a mixture of the two components solidifies rapidly. Amounts of the first component are provided in surface areas 64, 65 of the hinge links 66 and 67, respectively, of the lower limb portions 68 and 69, respectively, of the folding limbs, and amounts of the second component are provided in surface areas 70 and 71 of the associated slots in the other limb portions 72 and 73, respectively, of the folding limbs. Accordingly, when the frame is brought into the extended condition, the two components of the adhesive come in contact with each other, thus producing a rapidly solidifying mass which then interlocks the frame in the extended condition. Of course, the same measure can be also provided in the connector means between the non-folding limbs 74, 75 and the other ends of the limb portions 72, 73, and lower limb portions 68, 69, respectively. In any case, a rigid frame is obtained automatically after the extension thereof.

In FIGS. 5 to 13, various parts which in fact abut each other closely are illustrated for reasons of clarity as if they had small gaps between them.

I claim:

1. A stretcher frame for decorative materials serving as wall hangings, for artists' canvasses, and the like, the frame comprising two pairs of opposed limbs, the limbs of the first pair being at least as long as the limbs of the second pair, the limbs being hinged together in their end regions by first connector means for relative rotatable movement in the plane of the frame between an extended condition in which the limbs form a rectangle, and a collasped condition in which the limbs are disposed close together in substantially parallel relationship, each of the limbs of the second pair being subdivided half-way along its length, and the limb portions so formed hinged together by second connector means so as to be foldable inwards in said plane of the frame, whereby the frame is collapsible concertina-fashion, said first and second connector means each comprising a slot formed in one of the interconnected limbs or limb portions, and a flat hinge link connected to the associated other limb or limb portion and pivotally guided in said slot, said hinge link being shaped to be completely received in its slot in the extended condition of the frame, said slot and said hinge limb further defining an area portion which is separated in the collapsed condition of the frame but overlapping in the extended condition of the frame, said area being provided with a two component adhesive material in which each component alone is non-solid but a mixture of the two components will solidify rapidly, one of said components being provided on said hinge link, and the other of said components being provided in the associated slot, said limbs and limb portions having end faces which abut each other in the extended condition of the frame to prevent over-extending of the frame and to properly define said rectangle, and said limbs and limb portions being constituted by a plurality of superimposed interconnected sections of sheet material, the marginal contours of said sections being selected to provide the hinge links and the associated slots.

2. A frame according to claim 1, wherein in at least one connector means, a plurality of coaxial superimposed hinge links and associated slots are formed by a corresponding number of superimposed layers of sheet material.

3. A frame according to claim 1, wherein said first and second limbs comprise marginal portions adapted to interengage in the collapsed condition of the frame, said marginal portions being portions of said layers of sheet material.

4. A frame according to claim 1, wherein the layers of sheet material of at least one limb or limb portion are interconnected across substantially their whole surfaces, such as by cementing.

5. A frame according to claim 1, wherein the mutually abutting end faces of the limbs or limb portions have interlocking profiles.

6. A frame according to claim 1, including a sheet material of low specific weight such as cardboard, plastic, light weight honeycomb panels, corrugated paper, and the like.

7. A frame according to claim 6, wherein at least one of said first connector means comprises a nailed-through pin forming the axis of rotation of the connector means and holding the limb and the associated limb portion together.

8. A frame according to claim 1, wherein said second connector means each comprises a hinge strip of flexible material fastened to and bridging adjacent terminal portions of two limb portions to be hinged together.

9. A frame according to claim 8, wherein said hinge strip has a first lateral extension fastened to the one limb portion, and a second lateral extension fastened to the other limb portion.

10. A frame according to claim 8, wherein said hinge strip consists of adhesive tape.

* * * * *

UNITED STATES PATENT AND TRADEMARK OFFICE

CERTIFICATE OF CORRECTION

PATENT NO. : 4,361,180

DATED : November 30, 1982

INVENTOR(S) : Claus P. Stuvecke

It is certified that error appears in the above-identified patent and that said Letters Patent is hereby corrected as shown below:

Column 1, line 12, delete "comprises" and insert --- includes ---.

Column 10, line 11, after the word "hinge" insert --- strip ---.

Column 10, line 12, after the word "which" delete "strip".

Signed and Sealed this

*Twenty-third* Day of *August 1983*

[SEAL]

*Attest:*

GERALD J. MOSSINGHOFF

*Attesting Officer*

*Commissioner of Patents and Trademarks*